US006081240A

United States Patent [19]

Hemmingsen, II

[11] Patent Number: 6,081,240

[45] **Date of Patent: *Jun. 27, 2000**

[54] SATELLITE ANTENNA ALIGNMENT DEVICE

[76] Inventor: Robert J. Hemmingsen, II, 500 Wendy Heights Rd., Council Bluffs, Iowa 51503

[ * ] Notice: This patent is subject to a terminal disclaimer.

[21] Appl. No.: 09/369,623

[22] Filed: Aug. 6, 1999

Related U.S. Application Data

[63] Continuation of application No. 09/026,075, Feb. 19, 1998.

[51] Int. Cl.[7] ..... H01Q 3/02

[52] U.S. Cl. ..... 343/760; 343/882; 343/894; 248/544

[58] Field of Search ..... 343/882, 760, 343/894; 248/544, 27.1, 57, 343, 558

[56] References Cited

U.S. PATENT DOCUMENTS

| | | | |
|---|---|---|---|
| 2,064,236 | 12/1936 | Willis | 250/33.65 |
| 2,085,059 | 6/1937 | Woodside | 248/544 |
| 2,698,902 | 1/1955 | Farrow, Jr. et al. | 343/882 |
| 2,926,842 | 3/1960 | Ackerman | 33/379 |
| 3,816,000 | 6/1974 | Fiedler | 250/33.65 |
| 4,095,342 | 6/1978 | Oertli | 33/431 |
| 4,175,330 | 11/1979 | Hermann | 33/27 C |
| 4,422,738 | 12/1983 | Steele | 353/11 |
| 4,754,947 | 7/1988 | Propp | 248/544 |
| 4,771,548 | 9/1988 | Donnery | 33/512 |
| 4,866,852 | 9/1989 | Plier | 33/431 |
| 5,007,320 | 4/1991 | Craig et al. | 83/745 |
| 5,103,569 | 4/1992 | Leatherwood | 33/379 |
| 5,734,356 | 3/1998 | Chang | 343/882 |

OTHER PUBLICATIONS

Parts Express Catalog "Satellite Finder Kit", p. 13.
MCM Electronics Catalog 35 "Satellite Finder Kit", p. 246.
DBL Distributing, Inc. Catalog "Monster Cable Digital Satellite Finder", p. 10.
Petra Catalog "Perfect 10 Satellite Finder", p. 7, and "Monster Cable Monster Satellite Digital Satellite Finder", p. 10.

*Primary Examiner*—Don Wong
*Assistant Examiner*—James Clinger
*Attorney, Agent, or Firm*—Zarley, McKee, Thomte Voorhees & Sease; Dennis L. Thomte

[57] ABSTRACT

A satellite antenna alignment device is described for use with a satellite antenna to enable the satellite antenna to be aligned with respect to a particular satellite. The alignment device is operatively secured to the support arm of the satellite antenna and includes a compass for indicating the directional position of the support arm and also includes a clinometer.

7 Claims, 3 Drawing Sheets

SATELLITE ANTENNA ALIGNMENT DEVICE

CROSS-REFERENCE TO RELATED APPLICATION

This is a continuation application of Petitioner's earlier application Ser. No. 09/026,075 filed Feb. 19, 1998, entitled A SATELLITE ANTENNA ALIGNMENT DEVICE.

BACKGROUND OF THE INVENTION

1. Field of the Invention

This invention relates to a satellite antenna alignment device and more particularly to an alignment device which enables a satellite antenna to be aligned with respect to a particular satellite to enable the satellite antenna to properly receive the signals from the satellite.

2. Description of the Related Art

Satellite antennas are frequently used by owners of television sets to receive the signals from a particular satellite. In recent years, the small satellite antennas have become increasingly popular. Many different companies provide satellite television services such as DISH Network™, PRIMESTAR™, DIRECT TV™, etc. In most cases, each of the companies utilizes a particular satellite to transmit signals to their customers. In order for the satellite antennas to receive the signals from the satellite, it is necessary that the antenna be properly aligned with respect to the associated satellite. Generally, the satellite antennas have a low noise block amplifier with integrated feed (LNBF) mounted on the end of a support arm so that the dish will collect and focus the satellite signal onto the LNBF. Frequently, the manufacturer of satellite antennas will provide alignment information to the installers with that information being related to particular zip codes. For example, if a satellite antenna is going to be used with the DISH Network™ and is going to be used in zip code 68118, the manufacturer will advise the installer that the dish of the antenna must be directed or aimed along compass heading or azimuth 207 degrees and must be elevated upwardly from the horizontal 37 degrees.

Electronic devices have been provided for use in aligning satellite antennas which measure the strength of the satellite signals. However, it is necessary for the antenna to be generally aligned with the satellite before those electronic devices will function properly. The alignment of the satellite antennas frequently requires that at least two people be involved and the same is costly and time-consuming. In most satellite antennas, when viewed from the top or bottom thereof, i.e., a vertical plane, the LNBF support arm extends transversely from the dish. Thus, if the dish is aligned or aimed along a particular compass heading, the LNBF support arm will also extend along that same compass heading, but will not point directly at the satellite, since it does not extend from the dish at a right angle when viewed from the side. Normally, when viewed from the side, the plane of the dish and the LNBF support arm form an acute angle. In other words, the dish may be elevated 37 degrees from the horizon but the support arm may be elevated 44 degrees or so, depending upon the particular antenna.

In some cases, the installer attempts to manually align the antenna along the proper compass heading by holding a compass some distance below or above the support arm and then attempts to align the support arm along the proper compass heading. This procedure is crude, at best, and the metal construction of the support arm frequently interferes with the normal operation of the compass. Further, it is extremely difficult for the installer to elevate the dish to the proper elevation, after being directed along the proper azimuth, so that the antenna will be properly aligned.

SUMMARY OF THE INVENTION

An alignment device for a satellite antenna is described with the satellite antenna including a mast assembly, an amplifier support arm extending outwardly and upwardly from the mast assembly, an amplifier mounted on the outer end of the support arm, and a dish operatively secured to the support arm for movement therewith. The alignment device of this invention is operatively removably secured to the amplifier support arm and includes a compass for indicating the directional alignment of the support arm and further includes a clinometer means for indicating the angle of inclination of the support arm with respect to horizontal.

DESCRIPTION OF THE PREFERRED EMBODIMENT

Figure 2:
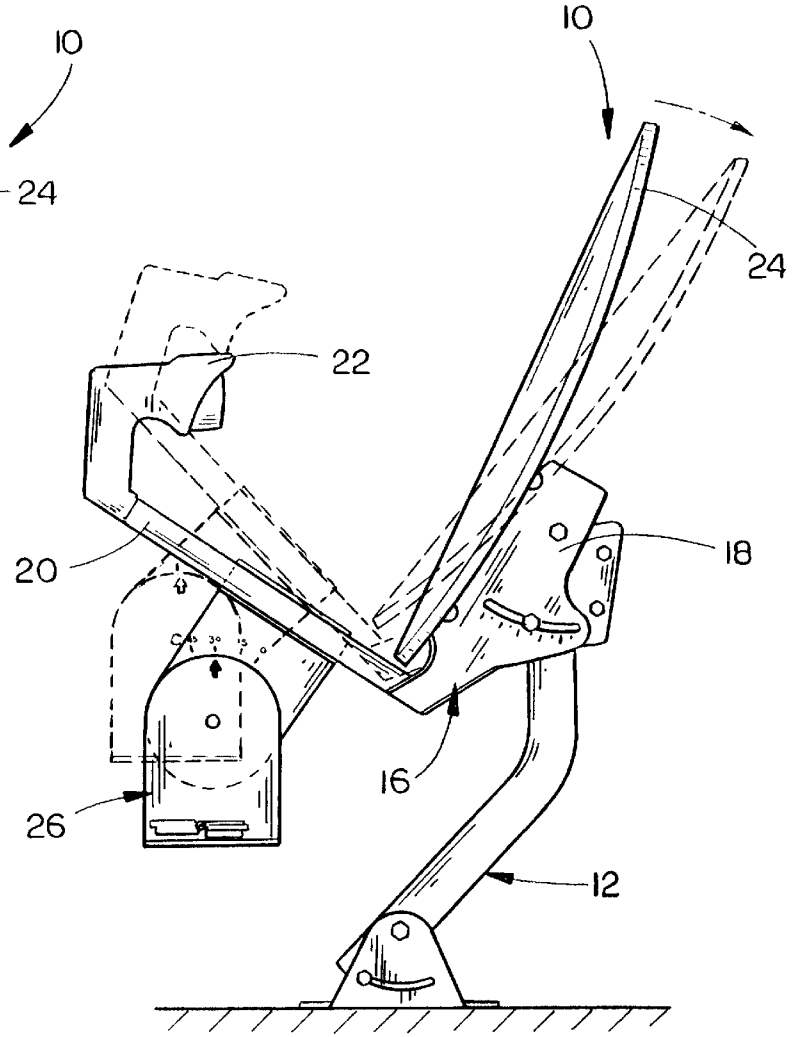
FIG. 2 is a side view of the antenna of FIG. 1 having the alignment device of this invention mounted thereon with the broken lines indicating possible movement of the antenna and alignment device.
Figure 1:
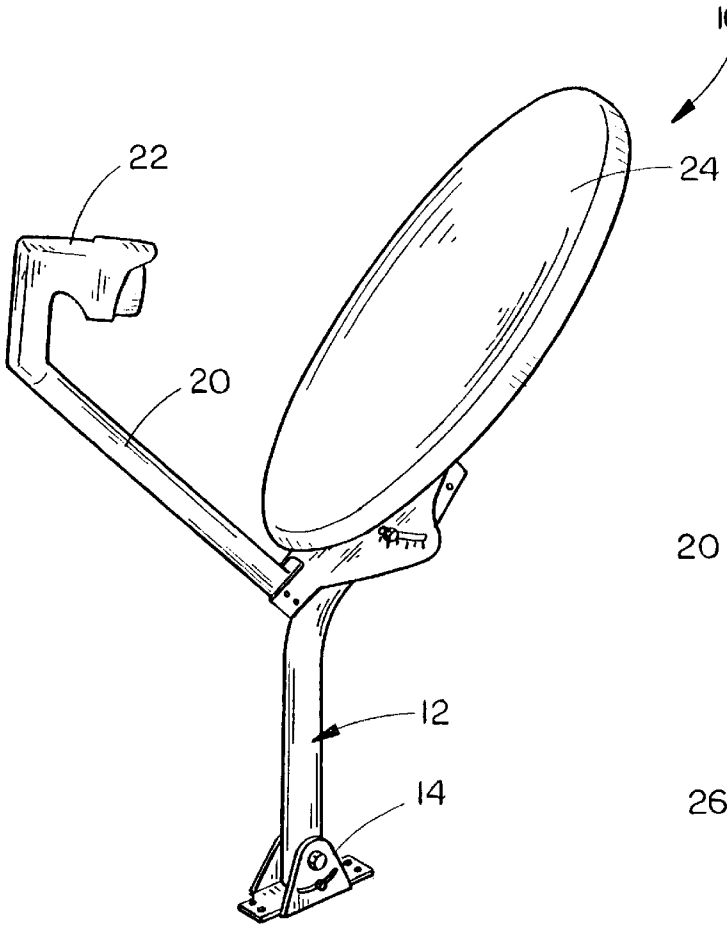
FIG. 1 is a perspective view of a conventional satellite antenna.
Figure 3:
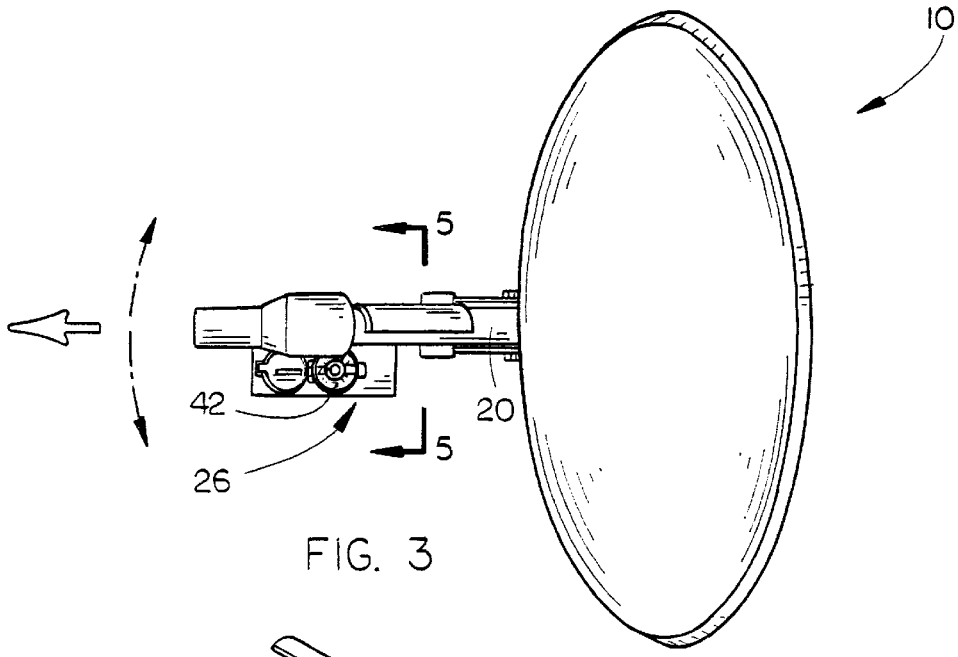
FIG. 3 is a top view of the antenna and alignment device of FIG. 2.
Figure 4:
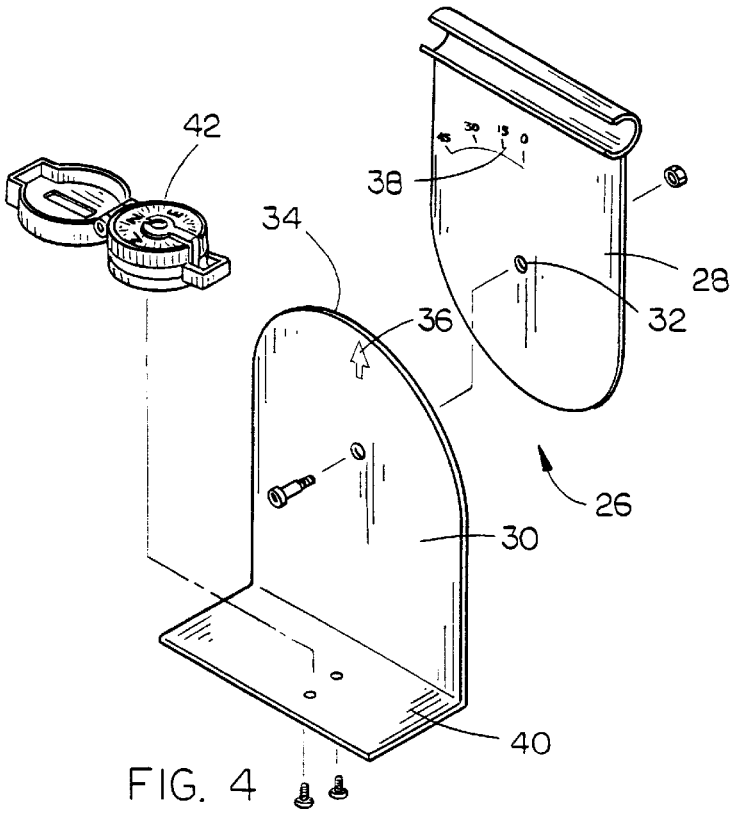
FIG. 4 is an exploded perspective view of the alignment device of FIGS. 2 and 3.
Figure 5:
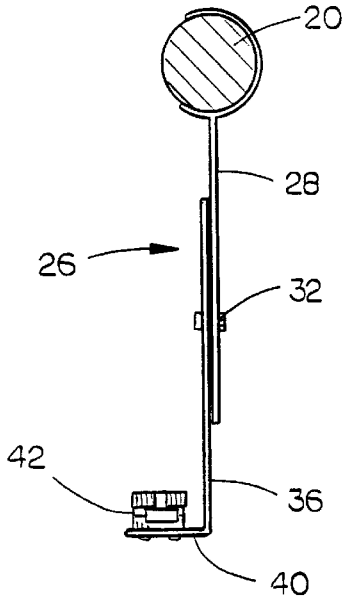
FIG. 5 is an enlarged sectional view seen on lines 5—5 of FIG. 3.

The numeral 10 refers to a conventional satellite antenna such as a DISH Network™ antenna. Other types of satellite antennas are also on the market such as PRIMESTAR™, DIRECT TV™, etc. Generally speaking, all satellite antennas normally include a mast assembly 12 having some sort of adjustable mounting bracket 14 at the lower end thereof for mounting the mast assembly 12 on a suitable supporting surface such as a roof, wall, floor, etc. In some installations, the mast assembly 12 illustrated in the drawings is replaced with a vertically disposed pole, post, or the like.

The numeral 16 refers to an amplifier support assembly including a bracket 18 which is movably adjustable attached to the mast assembly 12 in conventional fashion. Assembly 16 includes an elongated support arm 20 having a low noise amplifier with integrated feed (LNBF) 22 mounted thereon. Dish 24 is attached to the amplifier support arm assembly 16 in conventional fashion. Dish 24 collects and focuses the satellite signal onto the LNBF 22. When viewed vertically, the support arm 20 extends transversely (90 degrees) from the dish. In other words, the support arm 20 points in the same direction as the dish, but not in the same elevation. When viewed horizontally, the support arm 20 and the plane of the dish form an acute angle which varies depending upon the particular antenna. For example, an acute angle of 82.5 degrees may be formed by the dish 24 and the support arm 20. Thus, when dish 24 is elevated to 37 degrees, the arm 20 will be elevated 44.5 degrees.

The antenna 10 must be properly aligned or positioned with respect to a particular satellite so that the antenna will properly collect the satellite signal. In most instances, the manufacturer of the satellite antenna will provide information to the installer of the antenna concerning the proper alignment (azimuth and elevation) of the antenna based upon zip codes. For example, if the antenna is to be installed in zip code 68118, and is being used with the DISH Network™, the manufacturer will indicate that the dish must be aimed along compass heading or azimuth 207 degrees and that the dish must be elevated to an angle of 37 degrees with respect to horizontal. It is for such alignment purpose that the alignment device 26 of this invention has been developed.

Figure 8:
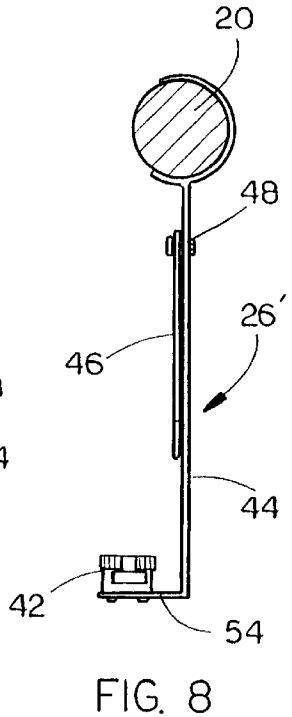
FIG. 8 is a sectional view taken through the support arm and which illustrates the alignment device of FIG. 6 from the end thereof.
Figure 7:
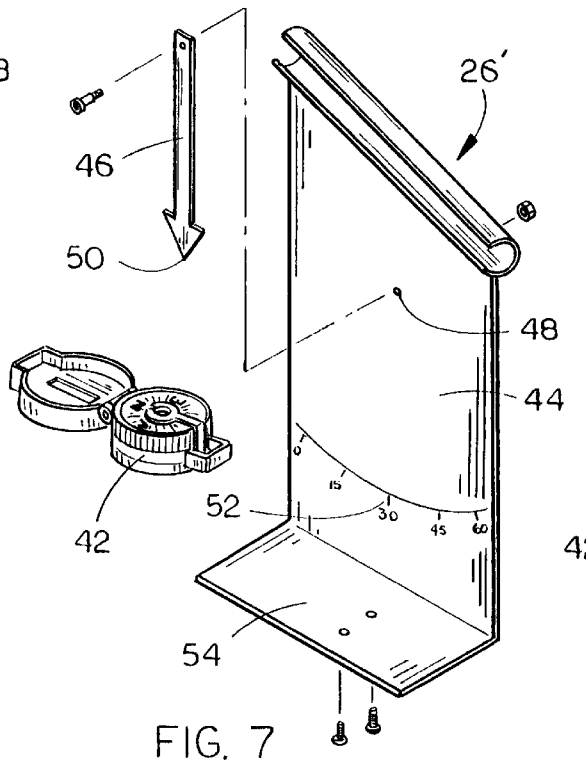
FIG. 7 is an exploded perspective view of the alignment device of FIG. 6.
Figure 6:
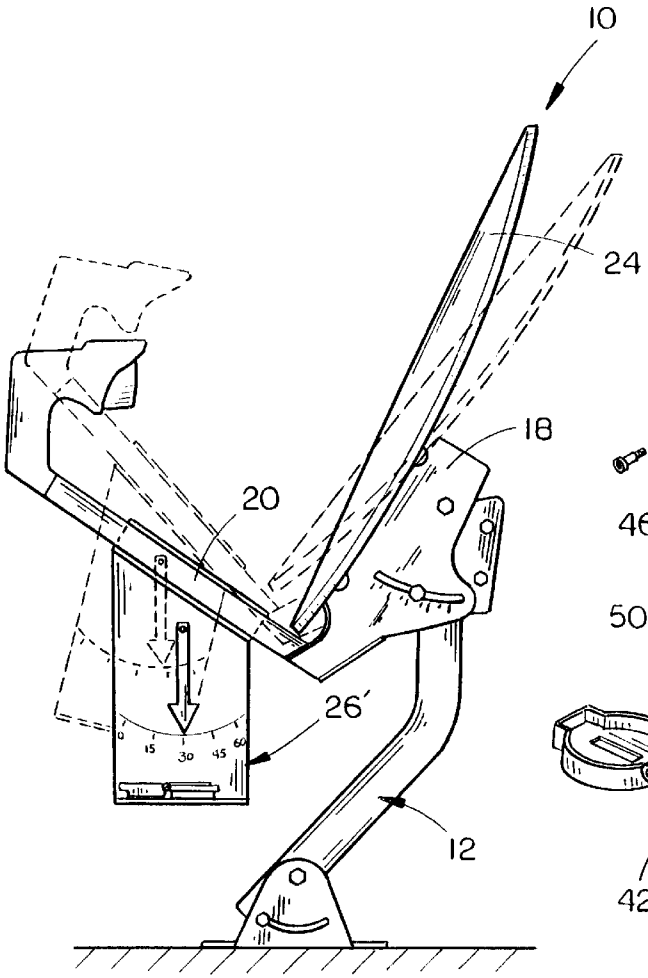
FIG. 6 is a side view similar to FIG. 2 with a modified form of the alignment device mounted thereon.

The alignment device 26 is preferably of the construction of FIGS. 1–5, but may also be configured as illustrated in FIGS. 6–8, wherein the alignment device is indicated by the reference numeral 26'. Alignment device 26 includes a flat, first support member 28 having its upper end removably secured to support arm 20 by any convenient means so that the plane of support member 28 is aligned with the longitudinal axis of support arm 20. A flat, second support member 30 is pivotally secured to support member 28 at 32. Support member 30 has a semi-circular, protractor-like upper end 34 and has a vertical indicia line 36 extending upwardly from pivot 32 to support end 34. Support member 28 is provided with angle indicia marks 38 for a purpose to be described hereinafter. In effect, support member 30 functions as a plumb bob and the support members 28 and 30 function as a clinometer. The lower end of support member 30 has a ledge or support surface 40 for supporting a conventional compass 42 thereon. The angle indicia marks 38 may be true indicia marks or may have the difference between 90 degrees and the acute angle already factored therein.

The alignment device 26', although somewhat different in design than device 26, performs the same function as device 26. Device 26 includes a flat, first support member 44 having its upper end removably secured to support arm 20. Plumb bob 46 has its upper end pivoted to support member 44 at 48 and has a pointed lower end 50. Support member 44 has angle indicia 52 thereof for indicating the angle of support member 44 (and arm 20) with respect to the plumb bob 46. Compass 42 is supported on ledge or support 54 on the lower end of support member 44, as seen in FIG. 7. Angle indicia 52 may be a true indicia mark or may have the difference between 90 degrees and the acute angle already factored therein.

Assuming first that the satellite antenna 10 is going to be installed in zip code 68118, and used to receive signals from the DISH Network™ satellite, the installer will know that the dish 24 must be aligned or pointed along the 207 degree azimuth and must be elevated upwardly from the horizon 37 degrees. The antenna mast assembly 12 is then mounted on its intended supporting surface. At this time, the support arm assembly 16 will be loosely connected to mast assembly 12 so that the support arm assembly 16, and dish 24, may be subsequently adjusted with respect to mast assembly 12. The alignment device 26 is then mounted on support arm 20 as previously described. The support arm 20 is then horizontally moved, with respect to mast assembly 12, until the longitudinal axis thereof is aligned with the 207 degree azimuth as indicated by the compass 42. The outer or upper end of support arm 20 is then moved upwardly or downwardly until the indicia mark 36 registers with the proper angle indicia mark 38. When the support arm 20 is properly aligned, the support arm assembly 16 is tightened onto mast assembly 12 in conventional fashion to maintain the antenna in its proper position. The alignment of the antenna may then be electronically "fine-tuned" if needed or desired. The alignment device enables the antenna 10 to be quickly and properly aligned with respect to the desired satellite. The positioning or spacing of the compass from the arm 20 prevents the metal construction of the support arm 20 from magnetically interfering with the proper operation of the compass.

If the device 26' of FIGS. 6–8 is being utilized, the same alignment procedure described hereinabove is performed, since devices 26 and 26' perform the same function, although in a slightly different manner.

Thus, it can been seen that the invention accomplishes at least all of its stated objectives.

I claim:

1. In combination:

a satellite antenna including a mast assembly, an amplifier support arm having opposite ends, one of said ends of said amplifier support arm being operatively secured to said mast assembly and extending upwardly and outwardly therefrom, at least one amplifier mounted on the other end of said support arm, a dish operatively secured to said support arm for movement therewith;

and a satellite antenna alignment device adapted to be removably positioned adjacent said support arm;

said alignment device including a first support member removably positioned adjacent said support arm and extending downwardly therefrom and a second support member fully pivotally secured to said first support member and extending downwardly therefrom;

said first support member having a protractor-like scale thereon;

said second support member having angle indicia thereon for use with said scale;

said second support member adapted to have a compass removably positioned adjacent thereto for indicating the direction which said support arm is pointing.

2. The combination of claim 1 wherein said first support comprises a flat member, having upper and lower ends, which dwells in a plane which is parallel to the longitudinal axis of said support arm and wherein said second support member comprises a flat member, having upper and lower ends, which dwells in a plane which is parallel to the longitudinal axis of said support arm.

3. The combination of claim 2 wherein said second support has means on its lower end for supporting the compass thereon.

4. The combination of claim 2 wherein the upper end of said first support member is removably secured to said support arm.

5. In combination:

a satellite antenna including a mast assembly, an amplifier support arm having opposite ends, one of said ends of said amplifier support arm being operatively, selectively movably secured to said mast assembly and extending angularly upwardly and outwardly therefrom, an amplifier mounted on the other end of said support arm, a dish operatively secured to said support arm for movement therewith with respect to said mast assembly;

said alignment device including a first support member removably secured to said support arm and extending downwardly therefrom, a plumb bob means pivotally mounted on said first support member and having upper and lower ends, said first support member having angle indicia means thereon adjacent the lower end of said plumb bob means;

said first support member adapted to have a compass positioned thereon for indicating the direction which said support arm is pivoting.

6. In combination with a satellite antenna including a mast assembly, an amplifier support arm having opposite ends, one of said ends of said support arm being operatively, selectively movably secured to said mast assembly and extending angularly upwardly and outwardly therefrom, an amplifier mounted on the other end of said support arm, a dish operatively secured to said support arm for movement therewith with respect to said mast assembly, comprising:

a satellite antenna alignment device operatively removably positioned adjacent said support arm for movement therewith including a clinometer means.

7. The combination of claim 6 wherein said alignment device is adapted to have a compass positioned thereon for indicating the direction which said support arm is pointing.

* * * * *